United States Patent [19]

Froom

[11] Patent Number: 4,669,614

[45] **Date of Patent: * Jun. 2, 1987**

[54] ICE CREAM CARTON AND BLANK

[76] Inventor: Thomas W. Froom, 10 Burncoat Way, Pittsford, N.Y. 14534

[ * ] Notice: The portion of the term of this patent subsequent to Nov. 26, 2002 has been disclaimed.

[21] Appl. No.: 739,966

[22] Filed: May 31, 1985

Related U.S. Application Data

[63] Continuation-in-part of Ser. No. 533,454, Sep. 19, 1983, Pat. No. 4,555,027.

[51] Int. Cl.[4] ..... B65D 5/54

[52] U.S. Cl. ..... 206/626; 53/467; 53/491; 206/611; 206/624

[58] Field of Search ..... 206/611, 624, 626, 609, 206/613; 229/33, 43, DIG. 4, 3.1; 53/467, 476, 491

[56] References Cited

U.S. PATENT DOCUMENTS

| | | | |
|---|---|---|---|
| 2,751,136 | 6/1956 | Moore | 206/633 X |
| 3,833,165 | 9/1974 | Hoiler | 206/624 X |
| 3,981,434 | 9/1976 | Ramich | 206/624 |
| 4,239,115 | 12/1980 | Froom | 206/611 |
| 4,386,705 | 6/1983 | Meuller | 206/626 |
| 4,431,129 | 2/1984 | Froom | 229/33 |
| 4,555,027 | 11/1985 | Froom | 206/626 |

*Primary Examiner*—William Price
*Assistant Examiner*—Bryon Gehman
*Attorney, Agent, or Firm*—Gordon W. Hueschen

[57] ABSTRACT

A box-shaped carton, for packaging ice cream or like frozen, initially liquid or semi-solid material which has a skirted cover and inturned lips on the front panel and front panel end flaps, which is formed by folding in the panel and flaps having a lip, and a resealing film arranged to either underlie or overlie the lips having enhanced protective properties for the contents, is disclosed.

18 Claims, 7 Drawing Figures

ICE CREAM CARTON AND BLANK

The present invention is a continuation-in-part of my prior-filed copending application Ser. No. 533,454, filed Sept. 19, 1983, now U.S. Pat. No. 4,555,027, issued Nov. 26, 1985.

FIELD OF INVENTION AND PRIOR ART

The invention relates to a box-shaped carton for packaging ice cream or like frozen, intially liquid or semi-solid material, to intermediates formed in the manufacture thereof, and to a process.

In my copending application Ser. No. 533,454 filed Sept. 19, 1983, U.S. Pat. No. 4,555,027, issued Nov. 26, 1985, there is disclosed an improved carton for packaging ice cream and like frozen, initially liquid or semi-solid material, which has substantial leakproof characteristics. It is an object of this invention to provide a still further improved carton of this type which has all the advantages described in said application and that is still more leakproof.

Other related packages for ice cream are found in U.S. Pat. No. 3,833,165 issued Sept. 3, 1974 to Stephen N. Hoiles and U.S. Pat. No. 3,981,434 issued Sept. 21, 1975 to Gary A. Ramich. These packages have some of the characteristics of the present invention but lack the leakproof properties of the present invention.

SUMMARY OF THE INVENTION

The invention relates to a carton blank comprising:

front, bottom, rear, and cover panels and a cover panel front flap adapted to be adhered to the front panel to form a collapsed parallelogram adapted to be opened up into a carton tube; front and rear panel end flap adapted to be infolded to form inner end walls and bottom flaps adapted to be infolded onto the inner end walls and adhered thereto to form ends for said carton;

said front panel end-flaps and said front panel having lips aligned in said carton blank and adapted to be infolded to underlie said cover panel in contact therewith and having complementarily-cut, corner-forming ends such that, in the fully closed carton, the inner edges of said front panel end flap lips align with the inner edge of said front panel lip to form a continuous, U-shaped line of contact with the underside of said cover panel; and cover panel front flap glue tabs cover panel end flaps adapted to be infolded and adhered together to form a skirted cover; and to the improvement in which:

said cover panel has releasably adhered to the underside thereof, and adhered to the adjacent portion of said rear panel, a resealing film of such an expanse that, in the fully closed carton, said resealing film overlaps said lips and the adjacent portion of said front panel but is not adhered to the latter.

The invention also relates to a tubular carton for packaging ice cream or like frozen, initially liquid or semi-solid material, formed of a single blank of carton stock which comprises:

a box-shaped body having front, rear, and bottom panels, and a cover panel articulated to the top edge of the rear panel, a closed end and an open end and, at said open end, end-flaps for closing the same comprising front and rear panel end flaps adapted to be infolded to form an inner end wall and a bottom panel end flap adapted to be infolded over said inner end wall and adhered thereto to form said end closure, and a cover panel articulated to the top of the rear panel;

said closed end being formed by front and rear panel end flaps infolded to form an inner end wall and a bottom panel end flap infolded onto and adhered to said inner end wall;

said cover panel having cover panel end flaps, one of which is infolded to a position overlying the closed end and the other of which is adapted to be infolded onto said end closure when it is formed, and a front cover panel front flap overlying and releasably sealed to said front panel and having glue tab extensions adhered to said cover panel end flap at the closed end and adapted to be adhered to the cover panel end flap at the opposite end of the carton when the end closure is formed to thereby form a skirted cover; each of the front panel end flaps having lip which is infolded at said closed end and adapted to be infolded at said open end to underlie said cover panel, and said front panel having a complementary lip infolded to underlie said cover panel so that, when the carton is filled and closed, a lip will extend along both front panel end flaps abutment with the front panel lip;

said lips having complementarily-cut, corner-forming ends and a width such that the inner edges of said end front panel end flap lips abut the inner edge of said front panel lip and the inner edges form a continuous U-shaped line in contact with the underside of the cover panel; and to the improvement in which:

a resealing film is releasably adhered to the underside of said cover panel and underlies the same from adjacent each end, is adhered to the top portion of said rear panel, and lies between said cover front-flap said front panel but is not adhered to the latter;

and said lips and said film being overlapped throughout the length of said lips, whereby said lips and said film cooperate in enhancing the leak-proof character of the carton. Additionally, the moisture-vapor barrier function of the film is enhanced by the overlapping of the lips and the film.

The invention also comprises one or more further features in which said cover panel end flaps are articulated to said cover panel by press-score fold-lines, thereby providing beads separting the underside of the cover panel from the cover panel end flaps, and said resealing film extends laterally at least up to said beads; in which said releasing film extends substantially up to said beads and not over them so that, when said front panel end flap lips are inserted under said cover panel in forming said end closure and said closed end, they ride up over said beads to underlie said film;

in which said resealing film extends over and projects beyond said beads so that, when said lips are inserted under the cover panel in forming said end closure and said closed end, they first overlie the portion of the film extending beyond said beads and then ride up over said beads into positions between said cover panel and said film;

in which said cover panel end flaps have tuck-in tabs adapted to be tucked in under the bottom panel end flaps after they are adhered to said inner end walls with unadhered space for said tuck-in tabs to be tucked in; and in which said cover panel end flaps have tear-out tabs which may be adapted to be adhered, in the fully erected carton, to said inner end walls and the portions of the bottom panel end flaps which overlap the same; and wherein said tear-out tabs have lines of weakness separably joining them to said cover panel end flaps and said tuck-in tabs.

The invention also relates to a package of ice cream or like frozen initially liquid or semi-solid material which comprises a carton as described above filled with material to be packaged to a level even with the tops of said panels and closed by said front panel end flap in which the end-closure lips are inserted between said material and the cover panel, and to a process for packaging ice cream or like frozen initially liquid or semi-solid material which comprises forming a carton as described above; filling said carton with the material to be packaged to a level even with the tops of said panels:

infolding the rear panel end flap;

infolding the lip on the front panel end flap at right angles thereto;

infolding the front panel end flap so that the infolded lip theron enters the carton between the cover panel and said material; and finishing said end closure, The invention in its package and process aspects also includes one or more further features in which said front panel end flap lip is inserted under said releasing film and in which said front panel flap lip is inserted between said releasing film and said cover panel.

DESCRIPTION OF THE PREFERRED EMBODIMENT

Figure 1:
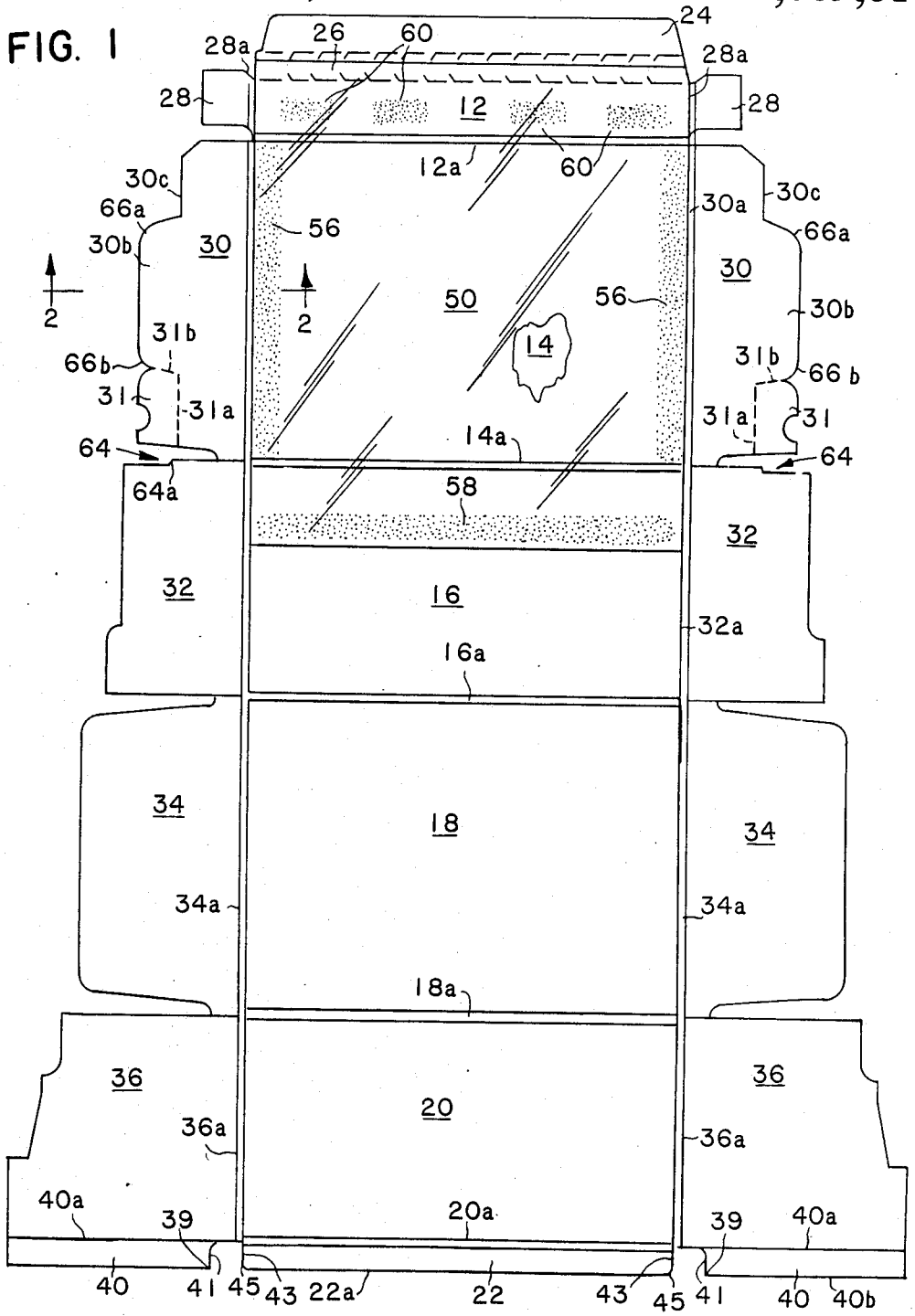
FIG. 1 is a plan view of a carton blank according to the invention.
Figure 2:
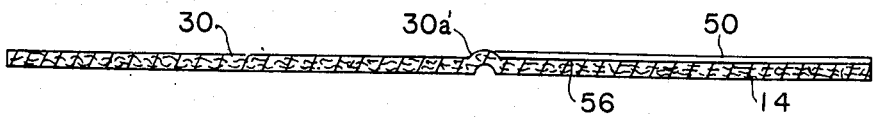
FIG. 2 is a modified section taken on line 2—2 of FIG. 1.

In FIG. 1 there is shown a carton blank 10 according to the invention which comprises cover panel front flap 12 and cover, rear, bottom and front panels 14, 16, 18, and 20, respectively. The cover panel front flap 12 is adapted to be adhered to the front panel 20 to form a collapsed parallelogram adapted to be opened up into a carton tube.

Extending laterally from the cover panel front flap 12, and panels 14, 16, 18, and 20, respectively, are glue tabs 28 and end forming flaps 30, 32, 34, and 36 which are articulated with the flap and panels by means of the vertical fold lines 28*a*, 30*a*, 32*a*, 34*a*, and 36*a* normal to the parallel fold lines 12*a*, 14*a*, 16*a*, 18*a* and 20*a*.

The flaps 30 are cover panel end flaps. Flaps 32, which extend laterally from the rear panel 16, are rear panel end flaps or inner-end-wall-forming flaps. Flaps 34, which extend laterally from the bottom panel end flaps or panel 18, are bottom end-wall-forming flaps. And flaps 36, which extend laterally from the front panel 20, are front panel end flaps or inner-end-wall-forming flaps.

Projecting laterally from the over panel front flap 12 are glue tabs 28, which are articulated therewith by vertical fold lines 28*a*. The vertical fold lines 30*a*, 32*a*, 34*a*, and 36*a* are aligned in an essentially common vertical fold line. The fold lines 28*a*, however, are displaced laterally with respect to the other vertical fold lines, so that the distance between the fold lines 28*a* is greater than the distance between the fold lines 30*a* such that, in the erected carton, the glue-tabs 28 overlie the cover panel end flaps 30.

If desired, the tear strip 26 can be omitted and a frangible applied to the panel 24 so that the cover panel front flap 12 can be readily broken away from the front panel 20.

The cover panel end flaps 30 are provided with tuck-in tabs 30*b* having rounded ends 66*a* and 66*b*. These tabs extend over the greater portion of the cover panel end flaps 30, but are inset from the ends thereof as shown at 30*c* to delineate the width of the tuck-in portion thereof.

Also, the front panel end-wall-forming flaps 36 have lips 40 articulated thereto by fold lines 40*a* aligned or substantially aligned with the fold line 20*a*. These fold lines are located so that, when the lips are folded in, the top faces thereof are substantially in the plane of the top edges of the carton front panel and end walls so that in the erected carton the lips 40, and optionally the lip 22, which is on the front panel 20, underlie the cover panel 14 in substantially flat surface-to surface contact. Also, fold lines 20*a* and 40*a* are aligned in the grain of the carton stock, as are score lines 12*a*, 14*a*, 16*a*, and 18*a*. It is sometimes advantageous to have the fold lines 40*a* displaced a small increment below the top of the carton in order to insure that the cover panel will be flat against the lips 40. If desired, the fold line 20*a* may be displaced below the top of the carton so that lip 22 has a small rise to the line where the edge 22*a* meets the underside of the cover panel 14.

The fold lines are formed by press-scoring or cut-scoring or the like in a manner already well known in the art. However, it is an advantage for the fold lines separating the panels from each other and from the flaps to be press-scored or creased fold lines, for the fold lines 40*b* to be half- or semi-cut-scored fold lines, and for the fold lines 20*a* be skip cut, with the parts between the skip cuts press-scored or crease-scored. It is of special advantage to have the cut-scored fold lines, particularly the half-cut or semi-cut scored fold lines 40*b*, aligned in the grain of the carton stock since the cuts are then not cross-grain cuts.

The inner ends of the lips 40 and outer ends of lip 22 have complementary corner-forming cuts. They are cut so that, in the erected carton, an edge of one lip abuts or is very close to an edge of the adjacent lip thereby forming a continuous, U-shaped line of contact between the cover panel and said lips. To this end, the lip 22, advantageously is square-cut, as shown at 43, a distance in from fold line 36*a* substantially equal to the thickness of the carton stock so that the square-cut ends 43 will substantially abut the panels 36 in the erected carton. Similarly, the lips 40 are square-cut back, as shown at 41, a distance substantially equal to the width of the lips so that in the erected carton corners 39 of the square-cut ends 41 substantially abut the corners 45 of lip 22 so that in the erected carton edges 40*b* and edge 22*a* form a continuous U-shaped line of contact with the underside of the cover panel 14. Also, the lips can be cut on complementary corner-forming angles (mitered), if desired. The outer ends of lips 40 can be beveled, or they can be left square as shown, i.e., in alignment with the outer edges of flaps 36, as shown in FIG. 1.

Figure 3:
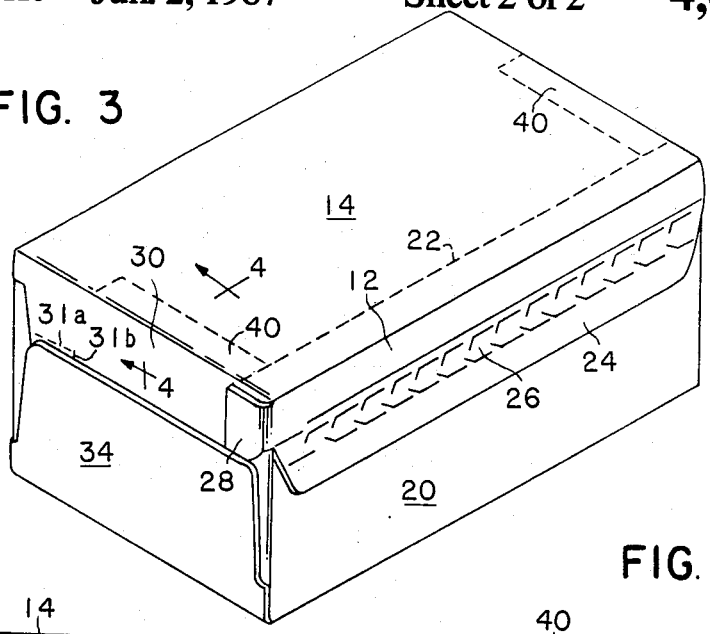
FIG. 3 is an isometric view of a package according to the invention.

Also, it is desirable to have the side cover panel end flap 30 provided with a tear-out tab 31 located so that in a closed end it overlaps the inner end-wall and underlies the bottom end-wall-forming flap 34, as seen in FIG. 3, with a tear line (line of weakness) 31*a*, in position to coincide, in a closed end, with the top edge of the bottom end-wall-forming flap 34 and a tear line 31*b* between it and the tuck-in tab 30*b*.

In assembling the carton, the rear panel end-wall-forming flap 32 is folded in first and then the front panel end-wall-forming flap 36, with lip 40 infolded at right angles, so that it overlies flap 32 and lip 40 underlies cover panel 14. Flap 32, advantageously, is cut down at 64 a distance equal, or substantially equal, to the thickness of the carton stock to accommodate lip 40 which then abuts the shoulder 64*a* of the uncut portion of flap 32 and keeps the flaps 32 and 36 from telescoping and thus prevents any inward movement of the top of the front panel 20. Then, the cover panel end-flap 30 is folded down with the bottom panel end-wall-forming flap 34 and the glue tab 28 folded back out of the way, and hot-melt glue is applied to the inner end wall and that part of the cover panel end-flap underlying the glue tab 28. The glue, advantageously, is applied in strips along the fold lines of the inner end wall.

Hot-melt glue is applied so that is covers the portion of the tear-out tab 31 lapped by the bottom panel end flap 34. Advantageously, the tear-out tab 31 can first be glued down to the rear panel end-wall-forming flap 32 and the glue strip run over the glued down tear-out tab 31 from, or to, the tear-line 31*a*, depending on whether the application of the hot-melt begins, or ends, at the tear-line 31*a*.

It is to be understood that the term "hot-melt glue" is to include any adhesive commonly applied by the hot application method.

Further details of this construction are given in my co-pending application Ser. No. 533,454 filed Sept. 19, 1983, now U.S. Pat. No. 4,555,027, issued Nov. 26, 1985, the disclosure of which is incorporated herein by reference. Also, details of the assembly and filling are there given. Suffice it to say that a carton tube, closed at one end, is formed by folding in one rear panel end flap 32 and then the corresponding front panel end flap 36 after first folding in the lip 40 thereon and inserting it in under the cover panel as that flap 36 is infolded. The cover panel end flap 30 at that end is then folded in and the glue tab 28 adhered thereto. Also, the tear-out tab 31, if desired, is adhered to the inner end wall. Then glue strips are applied along the fold lines of the inner end wall and the bottom panel end flap 34 infolded onto the glue strips. Care is taken to see that no part of the cover panel end-flap is adhered to the end wall except the tear-out tab 31 which is separably joined thereto.

The resulting cloesd-end tube, closed only at one end, is then filled with material to be packaged up to the fold lines and the closure made for the open end in the same sequence as just given for the closed end.

A characteristic feature of this invention lies in the fact that a re-sealing film 50 is releasably adhered to the underside of the cover panel 14 by glue strips 54 or 56, extends partway down the rear panel and is adhered thereto by glue strip 58, and extends down between the cover panel front-flap and the front panel but is not adhered to the front panel. If desired, the film can be releasably adhered to the cover panel front flap by spot-gluing as shown at 60. The re-sealing film extends laterally to a line where it either underlies or overlies the front panel flap end lips 40.

Thus, when the tear strip 26 is removed, the cover can be raised and, with the breaking away of the tear out tab 31, the re-sealing film 50, unlike that in U.S. Pat. No. 3,981,434, comes up with the cover to expose the ice cream and then, because of the releasable adhesive used, can be pulled away from the cover to overlie the contents of the carton.

The re-sealing film 50 cooperates with the inturned lips 40 and 22 to enhance the leakproofness of the carton.

In one modification the fold lines 30*a* are press-scored, thus providing beads 30*a'* along the ends sides of the cover panel 14 which function as ramps to guide the lips 40 as they are being inserted under the cover panel.

Figure 4:
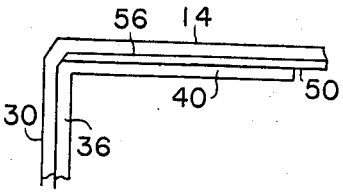
FIG. 4 is a partial section taken on line 4—4 of FIG. 3.

In one form of the invention the re-sealing film 50 extends up to, but not over, the beads 30*a'* so that when the lips 40 are inserted they ride up over the beads and over the film. This modification is illustrated in FIGS. 1 through 4 with FIG. 4 illustrating how the liner is disposed between the lip 40 and the cover panel 14. In this modification whatever glue is used to releasably adhere the re-sealing film can extend all the way up to the beads 30*a'*. In this form of the invention, the film 50 lies on top of both lips 40 and lip 22 and flat against the cover panel 14 and acts to improve the leakproof action of the U-shaped line of contact between the lips and the cover.

Figure 7:
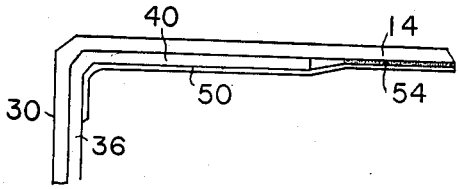
FIG. 7 is a partial section of a package according to the modification of FIG. 5 which is analogous to FIG. 4.
Figure 5:
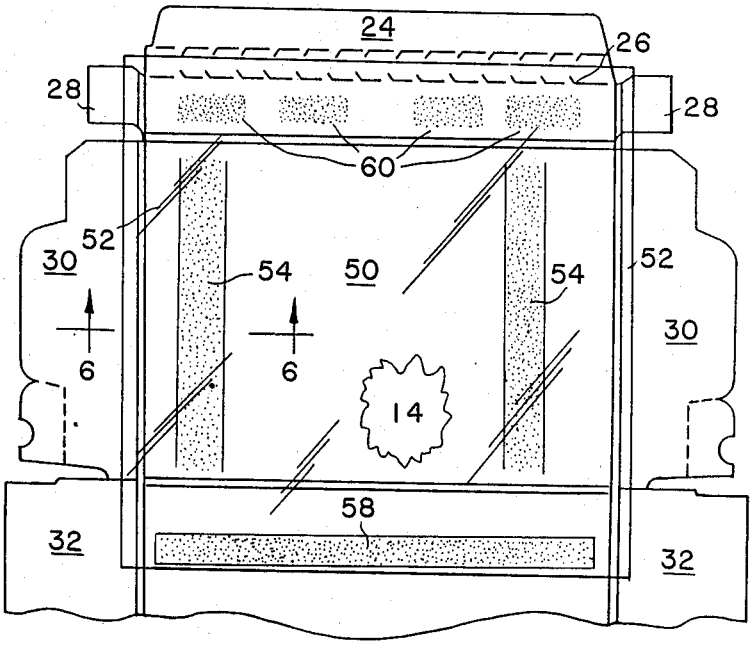
FIG. 5 is a partial plan view of a modified form of the invention.
Figure 6:
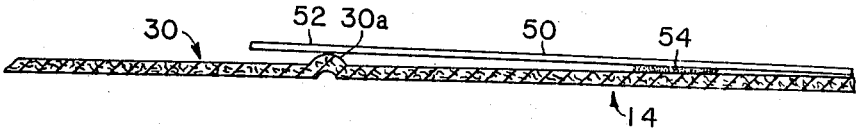
FIG. 6 is a partial section taken on line 6—6 of FIG. 5.

In the modification shown in FIGS. 5, 6, and 7 the re-sealing film 50 is extended over the beads 30*a'* as shown in FIG. 6. Thus, when the lip 40 is inserted it goes under the projecting portions 52 of the film, rides up over the bead 30*a'*, and to a position in between the film 50 and the cover panel 14 as shown in FIG. 7. In this case the glue 54 is spaced far enough away from the bead 30*a'* to accommodate the lip 40 as shown in FIG. 7. In this modification the film 50 overlies lip 22 and underlies lips 40. This serves to enforce the leakproof characteristic of the package by causing the film to be wedged in behind the edges 41 and 43 of the corners 39 and 45 and thus to promote the continuation of the U-shaped line of contact between the edges of the lips and the underside of the cover. It also causes the film to be detached from the cover and to remain on the surface of the ice cream as the package is opened.

Sometimes, if the glue strips 54 are far enough in, the lip will ride in between the film and the cover panel even if the film does not overlap the bead.

In both modifications the lips act to support the re-sealing film after the package is opened and to keep it from falling down in an irregular manner, so that the ice cream is more properly protected.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. In a carton blank comprising:

front, bottom, rear, and cover panels and a cover panel front flap adapted to be adhered to the front panel to form a collapsed parallelogram adapted to be opened up into a carton tube;

front and rear panel end flaps adapted to be infolded to form inner end-walls and bottom panel end flaps adapted to be infolded onto the inner end-walls and adhered thereto to form ends for said carton;

said front panel end flaps and said front panel having lips aligned in said carton blank and adapted to be infolded to underlie said cover panel in contact therewith and having complementarily-cut, corner-forming ends such that, in the erected and fully closed carton, the inner edges of said end flap lips align with the inner edge of said front panel lip to form a continuous, U-shaped line of contact with the underside of said cover panel;

cover panel front flap glue tabs and cover panel end flaps adapted to be infolded and adhered together to form a skirted cover;

the improvement in which:

said cover panel has releasably adhered to the underside thereof, and adhered to the adjacent portion of said rear panel, a resealing film of such an expanse that, in the erected and fully closed carton, said resealing film overlaps said lips and the adjacent portion of said front panel but is not adhered to the latter.

2. A carton blank of claim 1, in which the underside of said cover panel is separated from the underside of said cover panel end-flaps by beads formed by press-scoring, and the resealing film extends laterally at least substantially up to said beads.

3. A carton blank of claim 2, in which said resealing film extends substantially up to said beads and not over them.

4. A carton blank of claim 2, in which said resealing film extends over and projects beyond said beads.

5. A carton blank of claim 1, in which said cover panel end flaps have tuck-in tabs adapted to be tucked in under said bottom panel end flaps after the bottom panel end flaps are adhered to said inner end walls except for an unadhered space left for said tuck-in tabs to be tucked in.

6. A carton blank of claim 5, in which said cover panel end flaps have tear-out tabs, to the rear of said tuck-in tabs, which are adapted to be adhered, in the erected carton, to said inner end walls and to portions of said bottom end flaps which overlie the same; and lines of weakness separably joining said tear-out tabs to said cover panel end flaps and to said, tuck-in tabs.

7. A carton tube, for packaging ice cream or like frozen, initially liquid or semi-solid material, formed of a single blank of carton stock which comprises:

a box-shaped body having front, rear, and bottom panels, a closed end, and an open end and, at said open end, front and rear panel end flaps adapted to be infolded to form an inner end wall and a bottom panel end flap adapted to be infolded over said inner end wall and adhered thereto to form an end closure, and a cover panel articulated to the top edge of said rear panel;

said closed end being formed by front and rear panel end flaps infolded to form an inner end wall and a bottom panel end flap infolded onto and adhered to said inner end wall;

said cover panel having cover panel end flaps, one of which is infolded to a position overlying the closed end and the other of which is adapted to be infolded onto said end closure at the open end of the carton, and a cover panel front flap overlying and releasably sealed to said front panel and having glue tabs adhered to said cover panel end flap at the closed end and adapted to be adhered to the cover panel end flap at the open end when the end closure is formed to form a skirted cover;

the front panel end flap at each of said closed end and said unclosed end having a lip which is infolded in said closed end and adapted to be infolded in said unclosed end to underlie said cover panel and said front panel having a complementary front panel lip infolded to underlie said cover panel so that, when the carton is filled and closed, a lip will extend along each front panel end flap to abutment with the front panel lip;

said lips having complementarily-cut, corner-forming ends and a width such that the inner edges of said front panel end flap lips abut the inner edge of said front panel lip and the inner edges form a continuous U-shaped line in contact with the underside of the cover panel;

the improvement in which:

a resealing film is releasably adhered to the underside of said cover panel and underlies the same from adjacent each side thereof, is adhered to the top portion of said rear panel, and lies between said cover panel front flap and said front panel but is not adhered to the latter;

and said lips and said film being overlapped throughout the length of said lips, whereby said lips and said film cooperate in enhancing the leak-proof character of the carton.

8. A carton tube of claim 7, in which said cover end flaps are articulated to said cover panel by press-score fold-lines, thereby providing beads separating the underside of the cover panel from the cover panel end flaps, and said resealing film extends laterally at least substantially up to said beads.

9. A carton tube of claim 8, in which said resealing film extends substantially up to said beads and not over them.

10. A carton tube of claim 8 in which said resealing film extends over and projects beyond said beads.

11. A carton tube of claim 7, in which said cover panel end-flaps have tuck-in tabs adapted to be tucked in under the bottom panel end flaps after they are adhered to said inner end walls except for unadhered space left for said tuck-in tabs to be tucked in.

12. A carton tube of claim 11, in which said cover panel end-flaps have tear-out tabs which are adapted to be adhered, in the fully erected carton, to said inner end walls and to portions of the bottom panel end flaps which overlap the same; and wherein said tear-out tabs having lines of weakness separably joining them to said cover panel end flaps and to said tuck-in tabs.

13. A carton tube according to claim 7 filled with material to be packaged to a level even with the tops of said panels and closed by said end closure in which the front panel end flap lip is inserted between said material and the cover panel.

14. A carton tube of claim 13, in which said front panel end flap lip is inserted under said resealing film.

15. A carton tube of claim 13, in which said front panel end flap lip is inserted between said resealing film and said cover panel.

16. A process which comprises:

providing a carton tube according to claim 7;

filling said carton tube with the material to be packaged to a level even with the tops of said panels:

infolding the rear panel end flap;

infolding the lip on the front panel end flap at right angles thereto;

infolding the front panel end flap so that the infolded front panel end flap lip thereon enters the carton between the cover panel and said material; and completing said end closure.

17. A process of claim 16, in which said front panel end flap lip, during the infolding step, is guided so that it underlies said resealing film.

18. A process of claim 16, in which said front panel end flap lip, during the infolding step, is guided so that it goes in between the resealing film and the cover panel.

* * * * *

UNITED STATES PATENT AND TRADEMARK OFFICE

CERTIFICATE OF CORRECTION

PATENT NO. : 4,669,614

DATED : June 2, 1987

INVENTOR(S) : Thomas W. Froom

It is certified that error appears in the above-identified patent and that said Letters Patent is hereby corrected as shown below:

Title Page, [56] References Cited, U.S. PATENT DOCUMENTS, line 2; "Hoiler" should read -- Hoiles --
Title Page, [57] ABSTRACT, line 6; after "lips" insert a comma -- , --

Col. 1, line 11; "intially" should read -- initially --
Col. 1, line 37; after "bottom" insert -- panel --
Col. 1, line 40; "end-flaps" should read -- end flaps --
Col. 1, line 49; after "tabs" insert -- and --
Col. 1, line 66; "end-flaps" should read -- end flaps --
Col. 2, lines 3 & 4; delete ", and a cover panel articulated to the top of the rear panel"
Col. 2, line 13; delete "front" (first occurrence) --
Col. 2, line 20; after "having" insert -- a --
Col. 2, line 26; after "flaps" insert -- to --
Col. 2, line 29; delete "end" (first occurrence)
Col. 2, lines 37 & 38; change "cover front-flap said" to -- cover panel front flap and said --
Col. 2, line 57; before "lips" insert -- front panel end flap --
Col. 3, line 11; after "said" (second occurrence) insert -- end closure -- and delete "front panel end flap"
Col. 3, line 12; delete "end-closure" and insert -- front panel end flap --

Col. 3, line 22; "theron" should read -- thereon --
Col. 3, line 24; "closure," should read -- closure. --
Col. 3, line 28; after "panel" insert -- end --
Col. 3, line 53; after "bottom" insert a comma -- , --
Col. 3, line 67; delete "panel end"

Col. 3, line 68; delete "flaps or " and insert after "bottom" the words -- panel end flaps or --

UNITED STATES PATENT AND TRADEMARK OFFICE

CERTIFICATE OF CORRECTION

PATENT NO. : 4,669,614

DATED : June 2, 1987

INVENTOR(S) : Thomas W. Froom

It is certified that error appears in the above-identified patent and that said Letters Patent is hereby corrected as shown below:

Col. 4, line 4; "over" should read -- cover --
Col. 4, line 15; before "applied" insert -- glue --
Col. 4, line 15; before "panel" (first occurrence) insert -- glue --
Col. 4, line 31; "surface-to surface" should read -- surface-to-surface --
Col. 4, line 46; "40b" should read -- 40a --
Col. 4, line 50; "semi-cut scored" should read -- semi-cut-scored --

Col. 4, line 50; "40b," should read -- 40a, --
Col. 4, line 58; delete the comma "," after "22" and insert -- is -- at the end of the line
Col. 4, line 59; delete "is"
Col. 4, line 62; before "panels" insert -- ends of lips 40 on the --
Col. 5, line 6; delete "side"
Col. 5, line 24; "end-flap" should read -- end flap --
Col. 5, line 28; "end-flap" should read -- end flap --
Col. 5, line 58; "end-flap" should read -- end flap --
Col. 6, line 1; "front-flap" should read -- front flap --
Col. 6, line 6; "flap end" should read -- end flap --
Col. 6, lines 8 & 9; "tear out" should read -- tear-out --
Col. 6, line 18; delete "ends"
Col. 7, line 29; "end-flaps" should read -- end flaps --
Col. 8, line 34; after "cover" insert -- panel --
(line 1 of Claim 8)

UNITED STATES PATENT AND TRADEMARK OFFICE

CERTIFICATE OF CORRECTION

PATENT NO. : 4,669,614

DATED : June 2, 1987

INVENTOR(S) : Thomas W. Froom

It is certified that error appears in the above-identified patent and that said Letters Patent is hereby corrected as shown below:

Col. 8, line 43; insert a comma -- , -- after "8"
Col. 8, line 46; "end-flaps" should read -- end flaps --

Signed and Sealed this

Ninth Day of February, 1988

*Attest:*

DONALD J. QUIGG

*Attesting Officer*

*Commissioner of Patents and Trademarks*